US006260992B1

(12) United States Patent
Tanabe et al.

(10) Patent No.: US 6,260,992 B1
(45) Date of Patent: Jul. 17, 2001

(54) VEHICLE HEADLAMP DEVICE

(75) Inventors: Toru Tanabe, Yokohama; Shinji Fukuwa, Machida, both of (JP)

(73) Assignee: Stanley Electric Co., LTD, Tokyo (JP)

( * ) Notice: Subject to any disclaimer, the term of this patent is extended or adjusted under 35 U.S.C. 154(b) by 0 days.

(21) Appl. No.: 09/497,646

(22) Filed: Feb. 3, 2000

(30) Foreign Application Priority Data

Mar. 1, 1999 (JP) ..... 11-052874

(51) Int. Cl.[7] ..... F21V 17/02

(52) U.S. Cl. ..... 362/512; 362/513; 362/263; 362/538; 362/539; 362/303; 362/265; 362/295; 315/80; 315/82; 315/307

(58) Field of Search ..... 362/512, 513, 362/263, 538, 539, 303, 265, 295; 315/82, 83, 307

(56) References Cited

U.S. PATENT DOCUMENTS 5,448,139 * 9/1995 Luursema et al. ..... 315/308
5,965,986 * 10/1999 Borho et al. ..... 315/80
6,172,469 * 1/2001 Kern ..... 315/307
6,188,183 * 2/2001 Greenwood et al. ..... 315/307

FOREIGN PATENT DOCUMENTS 10-326507 12/1998 (JP) .
11-066912 3/1999 (JP) .
11-096806 4/1999 (JP) .

* cited by examiner

*Primary Examiner*—Sandra O'Shea
*Assistant Examiner*—Ali Alavi
(74) *Attorney, Agent, or Firm*—Morgan, Lewis & Bockius LLP

(57) ABSTRACT

A vehicle headlamp device is designed to provide the feeling that sufficient light quantity exists in the high beam (H-beam) mode despite the use of a single discharge light source. The headlamp can be produced at low cost and by simple construction without the need for installing an auxiliary reflective part on the reflective member. The vehicle headlamp device can include a discharge lamp light source, a switching device for switching between the high beam and low beam, and a lighting device which supplies electric power to the discharge lamp. The lighting device can be controlled such that the electric power supplied to the discharge lamp is increased only when the beam is switched to the H-beam mode by the switching device.

20 Claims, 8 Drawing Sheets

VEHICLE HEADLAMP DEVICE

This application claims the benefit of Japanese Application No. 11-052874, filed in Japan on Mar. 1, 1999, and which is hereby incorporated by reference.

BACKGROUND OF THE INVENTION

1. Field of the Invention

The invention concerns a lamp, and more specifically pertains to a vehicle headlamp system which uses a discharge lamp as a light source.

2. Discussion of the Related Art

Conventionally, filament light bulbs have been used as light sources in vehicle headlamp devices. Depending on the light bulb structure, a four-lamp or two-lamp type headlamp device is used. For example, a four-lamp conventional type headlamp device can be constructed as shown in FIG. 8. The four-lamp type headlamp device 1 is equipped with light bulbs 2 and 3 which are installed side by side on both sides of the front part of the vehicle (only the right-side headlamp device is shown in FIG. 8). One of the light bulbs 2 is configured to emit a so-called high beam (hereafter referred to as "H beam"), while the other light bulb 3 is configured to emit a so-called low beam (hereafter referred to as "L beam").

The respective light bulbs 2 and 3 are accommodated inside a lamp body housing 4, and are supplied with electric power by a lighting device not shown in the figure. Furthermore, the light bulbs 2 and 3 are equipped with respective reflective members 2*a* and 3*a* so that the light emitted by the respective light bulbs 2 and 3 is reflected by the reflective members 2*a* and 3*a*, and is thus directed to the front of the vehicle.

In a headlamp device 1 constructed as described above, only the light bulb 3 is lit in the L beam mode, while both of the light bulbs 2 and 3 are lit in the H beam mode. As a result, the H beam light that is emitted frontward has sufficient light quantity, and a driver is comforted by the increased formward field of vision which is due to an increased quantity of light in the H beam mode.

A conventional two-lamp type headlamp device 5 can be constructed, as shown in FIG. 9. A two-lamp type headlamp device 5 can be installed on both sides of the front of the vehicle (a right side headlamp is shown in FIG. 9). Each of these headlamp devices 5 is equipped with a single light bulb 6. The light bulb 6 generally has a double-filament structure equipped with two filaments 6*a* and 6*b* for emitting the L beam and H beam, respectively. The light bulb 6 is accommodated inside a lamp body housing 4, and is equipped with a hood 6*c* used to block the light. The light bulb is supplied with electric power by a lighting device not shown in the figure. In a headlamp device 5 constructed as described above, power is switched to filament 6*a* in the light bulb 6 during L beam mode, so that an L beam is emitted from the filament 6*a*. During H beam operation, power is switched to the filament 6*b* in the light bulb 6, so that an H beam is emitted from the filament 6*b*.

In the case of a so-called H4 type halogen lamp, which is a lamp commonly used in the above-mentioned light bulb 6, the lamp is constructed so that a 55 W filament 6*a* is used for the L beam mode, and a 60 W filament 6*b* is used for the H beam mode, at the rated voltage. As a result, when the H beam is used, the illuminated area is larger than that illuminated by the L beam. Accordingly, any insufficiency in the quantity of light in the forward field of vision is compensated for by the 5 W increase in electric power.

In recent years, discharge lamps such as metal halide lamps, etc., which are advantageous in terms of brightness and lamp life, etc., have begun to see practical use as light sources in vehicle headlamp devices in place of conventional halogen light bulbs. In the above-mentioned four-lamp type headlamp device 1, a headlamp device 1 can be constructed by using discharge lamps instead of the light bulbs 2 and 3, respectively. It is also possible to change only one of the light bulbs 2 or 3 to a discharge lamp. The H beam/L beam switching can also be performed with high quality and accuracy, just as in the case when halogen lamps are used.

Discharge lamps are expensive compared to halogen light bulbs. Accordingly, it is preferable to use discharge lamps in a two-lamp type headlamp device 5 in order to reduce costs as compared to a four-lamp type headlamp device 1.

However, discharge lamps emit light by means of a so-called arc light source in which electricity arcs through gas and between two electrodes to cause light. It is physically impossible to install two arc light sources, e.g., for H beam and L beam use, inside a single discharge lamp arc tube. Accordingly, in a conventional two-lamp type headlamp device 5 using discharge lamps as shown in FIG. 10, the device is constructed so that H beam/L beam switching is accomplished by a method such as moving a portion 8*a* of a hood 8 to block direct light emitted from the discharge lamp 7, or moving the discharge lamp 7 itself.

Specifically, in the case of the L beam, a portion 8*a* of the hood 8 is extended as shown in FIG. 10(A), so that the light-blocking area is expanded. As a result, the direction of light onto region 9*a* of the reflective member 9 that reflects light into the distance is blocked, and light incident to oncoming and other vehicles is minimized. When the H beam is used, the portion 8*a* of the hood 8 is withdrawn as shown in FIG. 10(B), so that the light-blocking area is contracted. As a result, light is directed onto region 9*a* of the reflective member 9 to reflect light into the distance. Thus, the H beam light is emitted into the distance by the reflective member 9. The discharge lamp 7 is generally a 35 W lamp.

In a two-lamp type headlamp device 5 using discharge lamps 7 as described above, the L beam is very bright, and can sometimes cause the operator to feel that there is insufficient light quantity when the beam is switched to the H beam. In order to compensate for this uncomfortable feeling, a large auxiliary reflective part 9*b* is installed at the outside of region 9*a* that reflects light into the distance, as indicated, for example, by the dotted line in FIG. 10.

The above-mentioned two-lamp type headlamp device 5 is arranged so that switching between the H beam and L beam is accomplished with discharge lamps 7 equipped with a single arc light source. As a result, the operator may further feel that there is insufficient light quantity when the beam is switched to the H beam. The large auxiliary reflective part 9*b* on the reflective member 9 also eliminates this uncomfortable feeling of insufficient light which is due to the presence of a single light source that operates in both H beam and L beam modes. Accordingly, the overall size of the headlamp device 5 is increased, due to the inclusion of reflective part 9*b*, and the degree of freedom in vehicle design is restricted.

SUMMARY OF THE INVENTION

In light of the above points, an object of the invention is to provide a vehicle headlamp device which is designed to eliminate the uncomfortable feeling that occurs when the beam is switched from the L beam to the H beam without a significant and/or noticeable change in light quantity. This uncomfortable feeling can be eliminated through simple construction of the lamp and without installing a large auxiliary reflective part on the reflective member.

In an aspect of the invention, a vehicle headlamp device can include a discharge lamp used as a light source, means for switching the discharge lamp between H beam and L beam, and a lighting device which supplies power to the discharge lamp, the lighting device being constructed such that the electric power supplied to the discharge lamp is controlled to increase only when the beam is switched to the H beam by the means for switching.

The discharge lamp is preferably supplied with a large electric power only when the beam is switched to the H beam. Accordingly, when the H beam is in use, the discharge lamp is lit by a larger quantity of light, and the feeling that the lamp does not have sufficient light quantity in the H beam mode is eliminated. As a result, good distant visual recognition characteristics are obtained, and a good feeling in terms of the quantity of light in the forward field of vision is obtained.

According to another aspect of the invention, the vehicle headlamp device can be configured such that the increase in electric power effected by the lighting device when in H beam is substantially equal to 20% of power supplied to the discharge lamp during the use of the L beam. In accordance with this aspect of the invention, when the electric power of the L beam is set at the rated electric power of the discharge lamp, an electric power increased by an amount equal to approximately 20% of the rated electric power or less is supplied to the discharge lamp when the H beam is in use. As a result, the brightest possible L beam and H beam can be emitted when in use. Furthermore, when the H beam is in use, the electric power can be kept within pemissible limits relative to the rated electric power, so that deleterious effects on the useful life of the discharge lamp can be minimized.

According to another aspect of the invention, the vehicle headlamp device can be configured such that the increase in electric power of the lighting device can be performed in synchronization with the switching operation of the means for switching. In this aspect of the invention, the increase in electric power of the lighting device is performed only when the H beam is in use. Accordingly, appropriate amounts of electric power can be supplied to the discharge lamp during the use of the L beam and the H beam, respectively.

According to another aspect of the invention, the vehicle headlamp device can be configured such that the increase in electric power of the lighting device is performed in accordance with a switching command signal of the means for switching. According to this aspect of the invention, the increase in electric power of the lighting device is performed using a switching command signal for the switching means. Consequently, when the vehicle operator performs a switching operation between the L beam and H beam, the increase in electric power of the lighting device is performed automatically. Accordingly, the operating characteristics are improved, and the increase in electric power of the lighting device can be performed reliably.

According to another aspect of the invention, the vehicle headlamp device can be configured such that the means for switching includes a hood used to block a portion of the light emitted from the discharge lamp and means for moving at least a portion of the hood, and the increase in electric power of the lighting device is performed in accordance with a hood movement command signal of the means for switching. In this aspect of the invention, when switching between the L beam and H beam is accomplished by using moving means to move a portion of the hood, the increase in electric power of the lighting device is accomplished using a hood movement command signal that is input into the moving means in order to move the hood. Consequently, when the vehicle operator performs a switching operation between the L beam and H beam, the increase in electric power of the lighting device is performed automatically. Accordingly, the operating characteristics are improved, and the increase in electric power of the lighting device can be performed reliably.

In accordance with another aspect of the invention, the means for switching includes a means for moving the discharge lamp, and the increase in electric power of the lighting device is performed in accordance with a discharge lamp movement command signal of the means for switching. In this aspect of the invention, when switching between the L beam and H beam is accomplished by using the moving means to move the discharge lamp itself, the increase in electric power of the lighting device is accomplished using a discharge lamp movement command signal that is input into the moving means in order to move the discharge lamp. Consequently, when the vehicle operator performs a switching operation between the L beam and H beam, the increase in electric power of the lighting device is automatically performed. Accordingly, the operating characteristics are improved, and the increase in electric power of the lighting device can be performed reliably.

In accordance with another aspect of the invention, the vehicle headlamp device can include a pair of discharge lamps and be constructed as a two-lamp system in which the discharge lamps are configured for placement at the right and left front of a vehicle, respectively. According to this aspect of the invention, switching between the H beam and L beam is accomplished by means of a single discharge lamp on each side of a vehicle, and the increase in electric power of the lighting device is personnel only when the H beam is used. Accordingly, the feeling of that the quantity of light in the forward field of vision is insufficient can be reliably eliminated.

In accordance with yet another aspect of the invention, a vehicle lamp can include a discharge lamp light source that includes an H beam operating mode and an L beam operating mode, a switch connected to the discharge lamp and configured to switch the discharge lamp between the H beam operating mode and the L beam operating mode, and a lighting device which supplies power to the discharge lamp, the lighting device being configured to provide a first amount of power to the discharge lamp when the discharge lamp is in the H beam operating mode, and to provide a second, different amount of power to the discharge lamp when the discharge lamp is in the L beam operating mode.

In accordance with still another aspect of the invention, a method for controlling a vehicle lamp can include the steps of connecting power to the discharge lamp and illuminating the discharge lamp, manipulating the switch to switch the discharge lamp between the H beam operating mode and the L beam operating mode, and causing a first amount of power to be supplied to the discharge lamp when the discharge lamp is switched to the H beam operating mode, and a second, different amount of power to be supplied to the discharge lamp when the discharge lamp is switched to the L beam operating mode, wherein the vehicle lamp includes a discharge lamp light source with an H beam operating mode and an L beam operating mode, a switch connected to the discharge lamp configured to switch the discharge lamp between the H beam operating mode and the L beam operating mode, and a lighting device which supplies power to the discharge lamp and is configured to provide a first amount of power to the discharge lamp when the discharge lamp is switched to the H beam operating mode and to provide a second, different amount of power when the discharge lamp is switched to the L beam operating mode.

DETAILED DESCRIPTION OF THE PREFERRED EMBODIMENTS

Below, preferred embodiments of the invention will be described in detail with reference to FIGS. 1 through 7.

Figure 1:
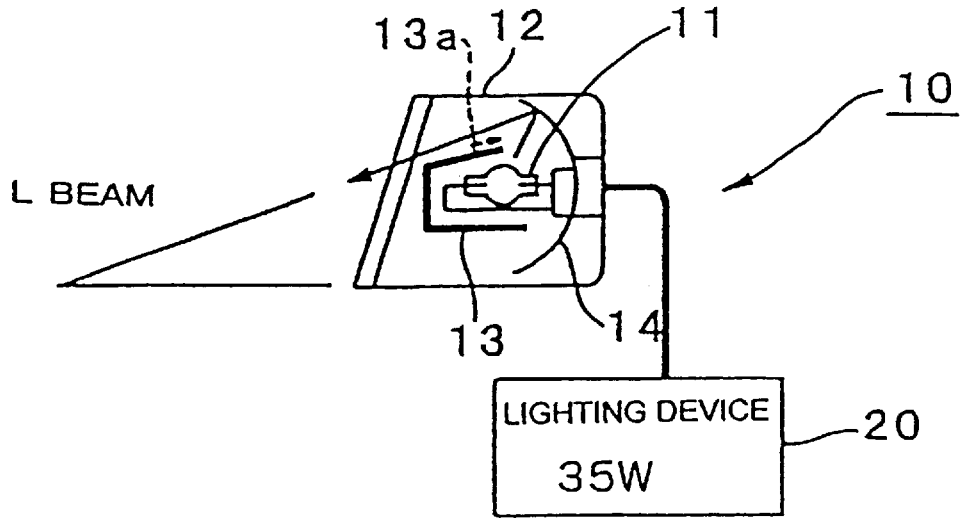
FIG. 1 is a schematic sectional side view of a vehicle headlamp which illustrates the conditions during L beam mode in an embodiment of the invention.
Figure 2:
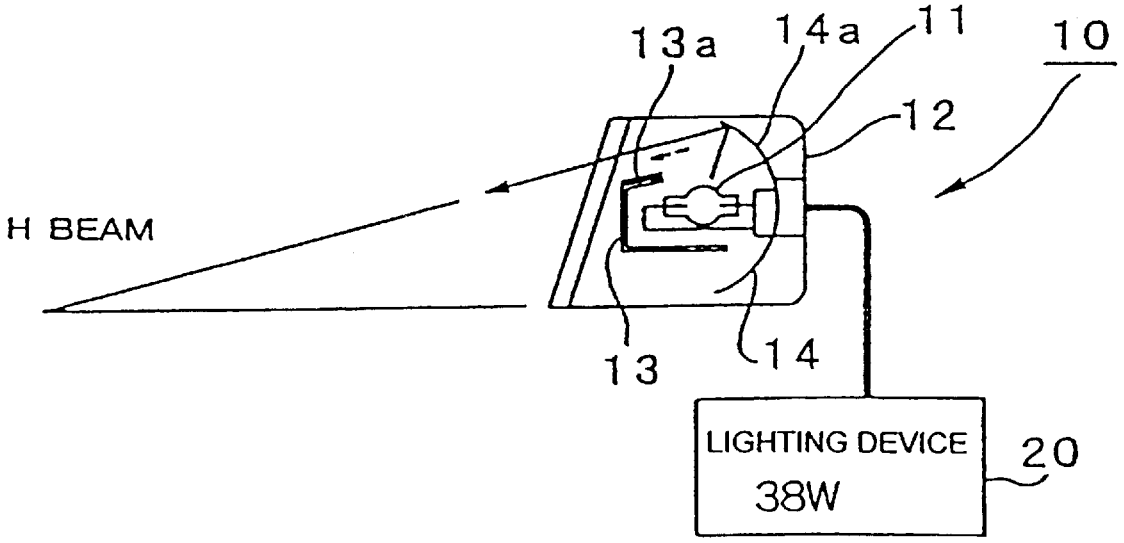
FIG. 2 is a schematic sectional side view which illustrates the conditions during H beam mode in the vehicle headlamp device shown in FIG. 1.

FIGS. 1 and 2 show the construction of a working configuration of a vehicle headlamp device constructed according to the invention. The vehicle headlamp device 10 can be equipped with a single discharge lamp 11 used as a light source, which is installed on both sides of the front of a vehicle (in FIGS. 1 and 2, only the headlamp device on one side of a vehicle is shown). The discharge lamp 11 can be constructed so that light is emitted as a result of the discharge of an arc light source.

The discharge lamp 11 can be accommodated inside a lamp body housing 12, and equipped with a hood 13 used as a switching means, and a reflective member 14 used for reflection. The discharge lamp 11 can be lit by electric power supplied by a lighting device 20. A metal halide lamp may be used as the discharge lamp 11. However, other types of discharge lamps may also be used.

Figure 3:
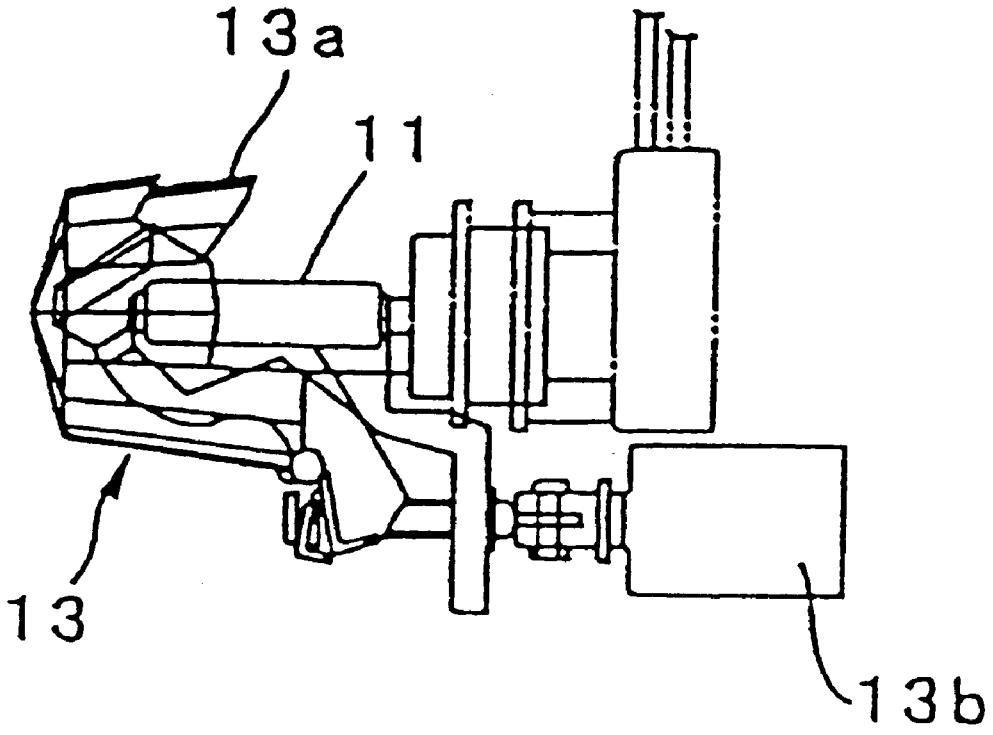
FIG. 3 is a schematic sectional view which shows the detailed construction of the hood in the vehicle headlamp device shown in FIG. 1.

As is shown in FIG. 3, the hood 13 can be constructed so that a portion 13*a* of the hood 13 is a movable hood, while the remainder of the hood 13 is constructed as a fixed hood formed in a concave shape with respect to the discharge lamp 11. The movable hood 13*a* can be moved in the forward-backward direction by a solenoid 13*b* driven by switching command signals from a beam switching device.

When the lamp is in the L beam mode, portion 13*a* of the hood 13 is extended by the solenoid 13*b* as shown in FIG. 1, so that the light-blocking area is expanded. As a result, the light incident on the region 14*a* of the reflective member 14 that reflects light into the distance is interrupted such that persons facing the vehicle headlamp device are not subjected to glare.

When the lamp is in the H beam mode, portion 13*a* of the hood 13 is retracted by the solenoid 13*b* as shown in FIG. 2, so that the light-blocking area contracts. As a result, light is directed onto region 14*a* of the reflective member 14 such that the H beam is emitted into the distance by the reflective member 14.

Figure 4:
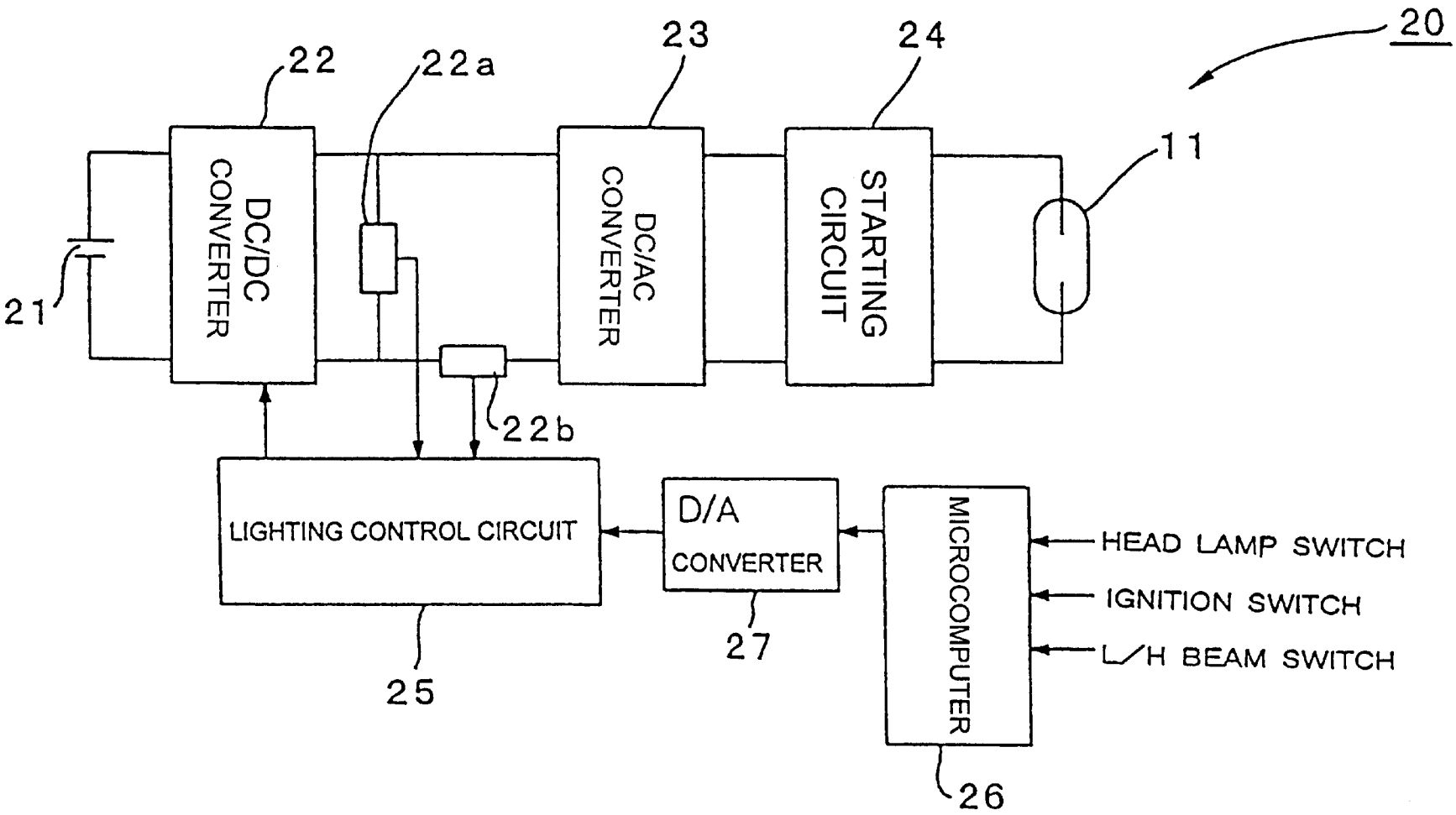
FIG. 4 is a block diagram which shows an electrical schematic of the lighting device for the vehicle headlamp device shown in FIG. 1.

As shown in FIG. 4, the lighting device 20 can include: a DC/DC converter 22 which is connected to the battery 21 of the vehicle; a DC/AC converter 23; a starting circuit 24 which is connected to the discharge lamp 11; and a lighting control circuit 25. The DC/DC converter 22 can have a universally known construction, and is used to step up the direct current from the battery 21. The DC/AC converter 23 can also have a universally known construction, and is used to convert the direct current from the DC/DC converter 22 into an alternating current. The starling circuit 24 can also have a universally known construction and generates a high-voltage pulse used to initiate the lighting of the discharge lamp 11. After lighting, the circuit supplies AC electric power (supplied from the DC/AC converter 23) to the discharge lamp 11.

The lighting control circuit 25 performs, for example, PWM control of the DC/DC converter 22 on the basis of voltage and current values. A voltage detection part 22*a* detects the output voltage of the DC/DC converter 22, and a current detection part 22*b* detects the output current of the DC/DC converter 22, so that an appropriate electric power is supplied to the discharge lamp 11.

The lighting device 20 can be constructed so that control signals are input into the lighting control circuit 25 from a microcomputer 26 via a D/A converter 27. The microcomputer 26 can be arranged so that switching command signals from an L beam/H beam switch, etc., are input into the microcomputer 26. A digital/analog conversion is performed by the D/A converter 27 on the basis of these switching command signals such that an H level switching control signal is output to the lighting control circuit 25 when an H beam is desired, and an L level switching control signal is output to the lighting control circuit 25 when an L beam is desired.

Furthermore, the microcomputer 26 can be initialized when the ignition switch of the vehicle is switched on, and the operating state, i.e., the on-off state, of the headlamp switch is input. In response, when an H level switching control signal is input into the lighting control circuit 25 from the microcomputer 26, the lighting control circuit 25 controls the DC/DC converter 22 such that the electric power supplied to the discharge lamp 11 is increased by approximately 20% or less.

Conversely, when an L level switching control signal is received by the lighting control circuit 25 from the microcomputer 26, the lighting control circuit 25 controls the DC/DC converter 22 so that the electric power supplied to the discharge lamp 11 is returned to the original electric power.

Preferably, the lighting control circuit 25 supplies an electric power of approximately 35 W to the discharge lamp 11 when the L beam is in use and approximately 38 W when the H beam is in use. Thus, the lighting control circuit 25 can increase the electric power supplied to the discharge lamp 11 to approximately 38 W when the H beam is used. It is also possible to input switching command signals directly into the lighting control circuit 25, thus eliminating the need for the microcomputer 26 and D/A converter 27.

Figure 5:
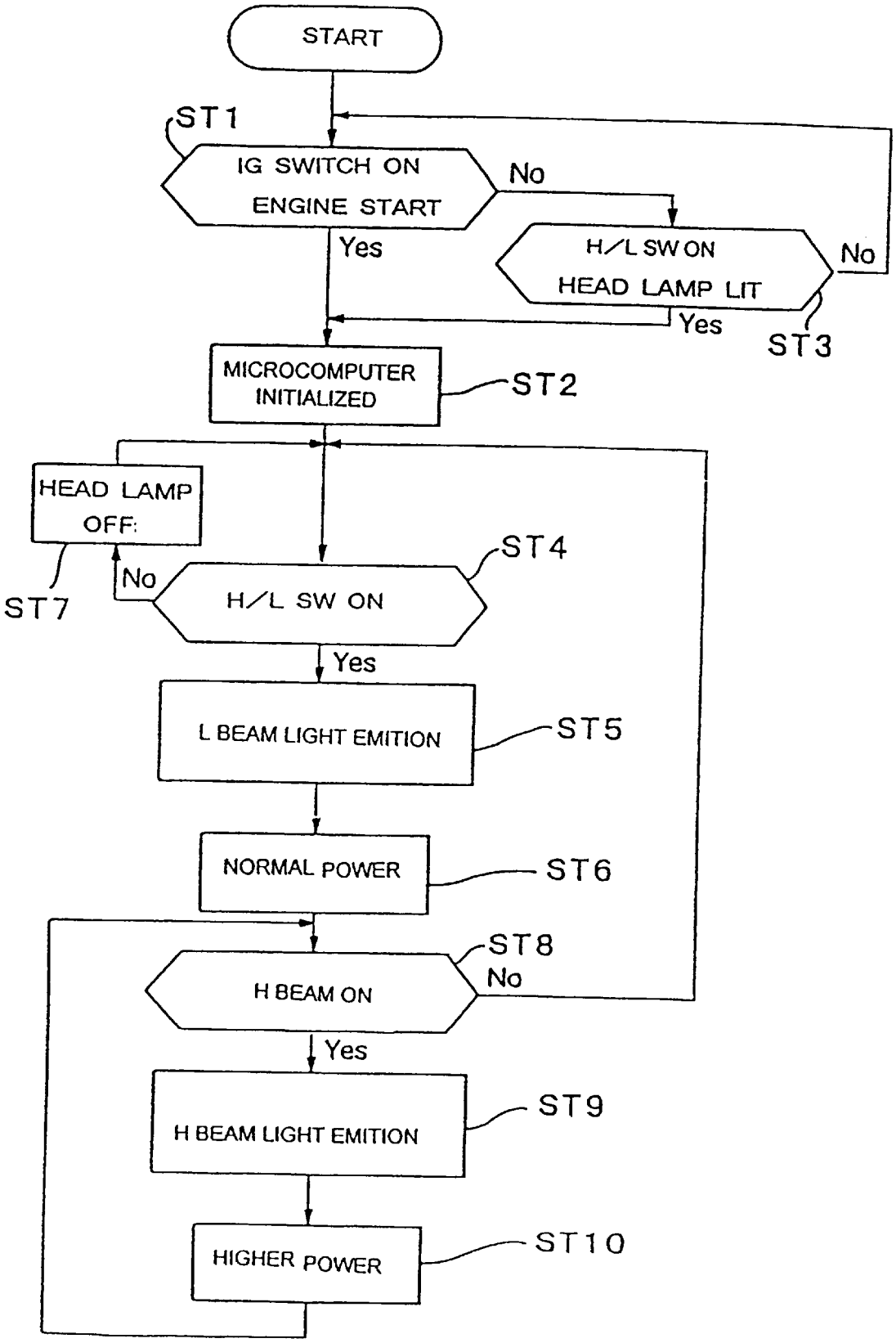
FIG. 5 is a flow chart which illustrates the beam switching operation steps ST1–ST10 of the vehicle headlamp device shown in FIG. 1.

The vehicle headlamp device 10 can be constructed as described above, and can operate as follows in accordance with the flow chart shown in FIG. 5. First, when the ignition switch of the vehicle is switched on so that the engine is started in step ST1, the microcomputer 26 is initialized in step ST2. If the ignition switch is off in step ST1, the on-off state of the headlamp is ascertained in step ST3. If the headlamp switch is on, the headlamp is lit, and the microcomputer 26 is initialized in step ST2. However, if the headlamp switch is off in step ST3, the processing returns to step ST1.

Following the initialization of the microcomputer 26 in step ST2, the on-off state of the headlamp switch is ascertained in step ST4. If the headlamp switch is on, the solenoid 13*b* of the hood 13 is driven and controlled in step ST5 so that the movable hood 13*a* is moved to the extended position in order to achieve L beam light emission. Then, in step ST6, the lighting control circuit 25 supplies the rated electric power to the discharge lamp 11. As a result, the discharge lamp 11 is lit by the rated electric power, for example, approximately 35 W. The light from the discharge lamp 11 is blocked by the movable hood 13*a* which is in its extended position, and the light that is reflected by the reflective member 14 is emitted forward as an L beam.

When the headlamp switch is off in step ST4, the lighting control circuit 25 does not supply electric power to the discharge lamp 11. Accordingly, the discharge lamp 11 is not lit and processing returns to step ST4.

Next, when the vehicle beam switch is switched on and the beam switch is switched to H beam while the L beam is being emitted in step ST6, the solenoid 13*b* is driven and controlled in step ST8 so that the movable hood 13*a* is moved to the retracted position in order to achieve H beam light emission. Then, in step ST9, the lighting control circuit 25 supplies an electric power which is greater than the rated electric power, e. g., an electric power of approximately 38 W, to the discharge lamp 11. As a result, the discharge lamp 11 is lit at a higher brightness. Furthermore, as a result of the movable hood 13*a* being in the retracted position, the light from the discharge lamp 11 is also incident on the region 14*a* of the reflective member 14 such that light is reflected by the entire reflective member 14, thus causing light to be emitted in the forward direction as an H beam. Afterward, the processing returns to step ST7.

When the lamp is in the H beam mode, the illuminated area of the forward field of vision is expanded and the lighting control circuit 25 supplies an electric power that is larger than the rated electric power to the discharge lamp 11. Accordingly, the discharge lamp 11 emits brighter light, and any feeling that the quantity of light is insufficient due to the use of an expanded illumination area with only a single light source can be eliminated. Thus, good distant visual recognition characteristics are obtained in H beam mode, and a good feeling in terms of the quantity of light in the forward field of vision can be realized.

Furthermore, when the rated electric power is 35 W, the discharge lamp 11 has an electric power range of 30 W to 38 W in accordance with European standards. Since the utilization rate of the H beam in use is relatively low, there is little deterioration of the useful life of the lamp even when the lamp is lit by an electric power of 38 W.

When the beam switch is switched off in step ST7 so that the beam is switched to the L beam, the processing returns to step ST4, and the on-off state of the headlamp switch is ascertained in step ST4. In cases where the headlamp switch is on, the L beam is again emitted at the rated electric power (35 W) in steps ST5 and ST6.

Figure 6:
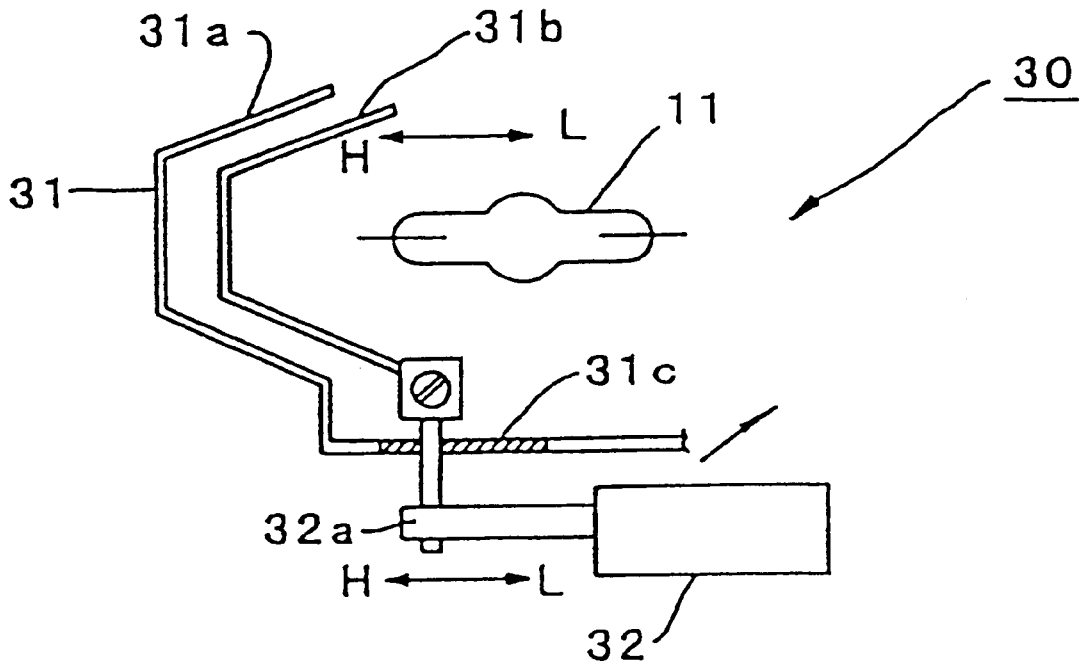
FIG. 6 is a schematic partial sectional view of another embodiment of the vehicle headlamp device of the invention.

FIG. 6 illustrates another embodiment of the vehicle headlamp device of the invention. The vehicle headlamp device 30 can differ from the vehicle headlamp device 10 shown in FIGS. 1 and 2 only in that the vehicle headlamp device 30 is equipped with a hood 31 instead of the hood 13 shown in FIG. 3. The hood 31 can be considered a means for switching between the H beam and the L beam for the headlamp.

The hood 31 can be constructed from a fixed hood 31*a* which is formed in a concave shape with respect to the discharge lamp 11, and a movable hood 31*b* which is supported so that it can be moved in the forward-rearward direction on the inside of the fixed hood 31*a*.

The movable hood 31*b* can be supported on the movable part 32*a* of a solenoid 32 via a guide hole 31*c* formed in the undersurface of the fixed hood 31*a* which can be fastened to the lamp body housing 12. When the solenoid 32 is actuated, the movable hood 31*b* is caused to move in the forward-rearward direction (as indicated by the arrows in FIG. 6) by the movement of the movable part 32*a* of the solenoid 32. When the movable part 32*a* moves in the forward direction, the movable hood 31*b* is brought to the H beam position, and when the movable part 32*a* moves in the rearward direction, the movable hood 31*b* is brought to the L beam position.

In the vehicle headlamp device 30 described above with reference to FIG. 6, the lighting control circuit 25 can supply electric power to the discharge lamp 11 that is larger than the rated electric power of the lamp only when the beam is switched to H beam mode. The switch to H beam mode can be accomplished by movement of the movable hood 31*b* which is used as a switching means. Accordingly, any feeling that the quantity of light is insufficient during the use of the H beam is eliminated.

Figure 7A:
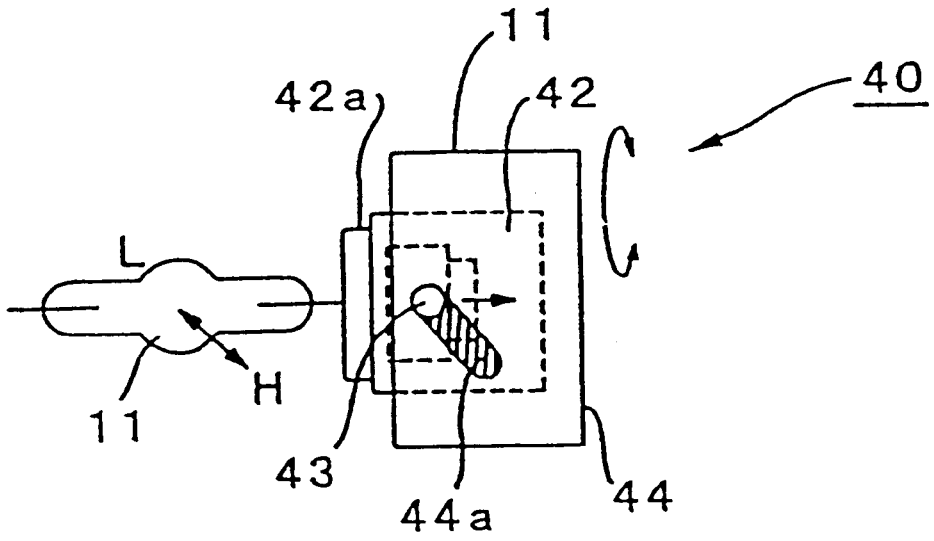
FIGS. 7A–B are a schematic sectional view and schematic perspective view, respectively, of another embodiment of the vehicle headlamp device of the invention.
Figure 7B:
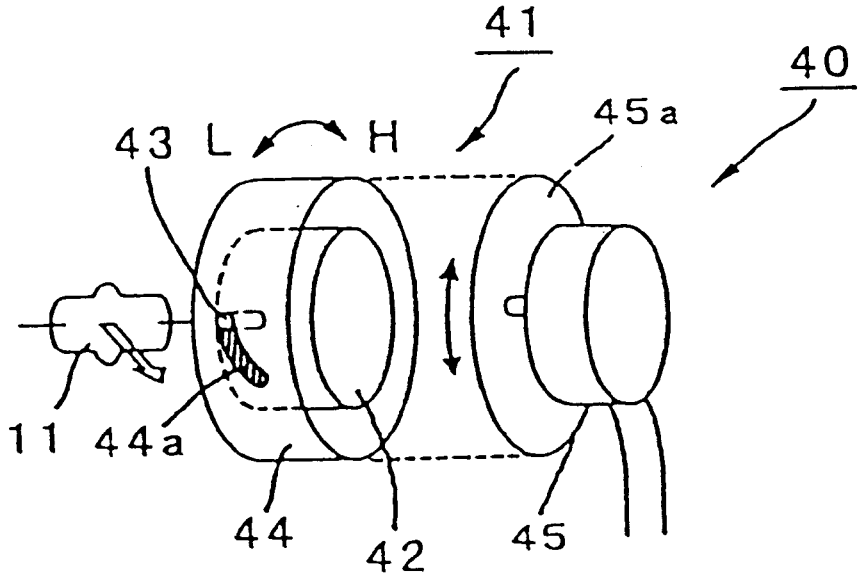
Figure 8:
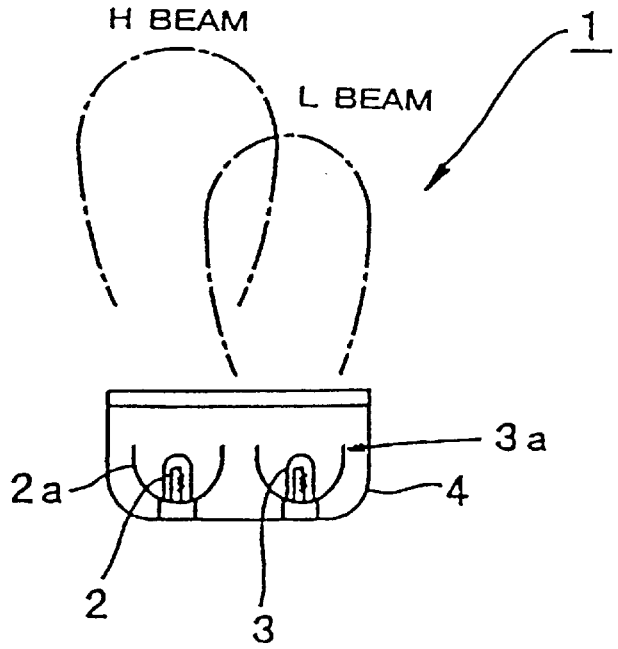
FIG. 8 CONVENTIONAL ART
FIG. 8 is a schematic top view of a conventional four-lamp type vehicle headlamp device.
Figure 9:
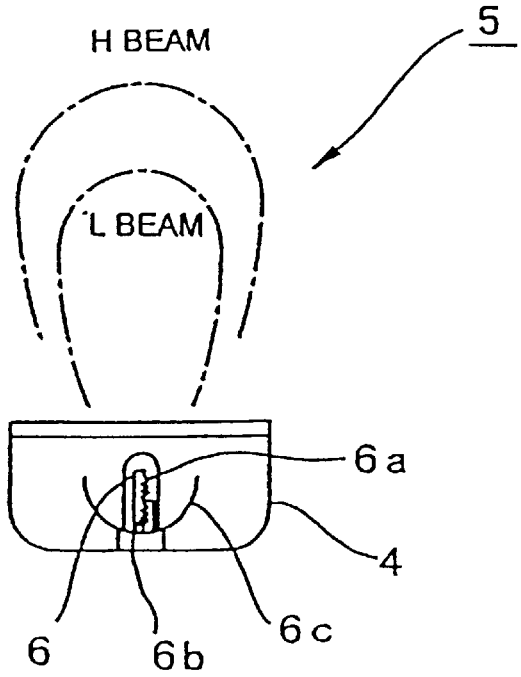
FIG. 9 CONVENTIONAL ART
FIG. 9 is a schematic top view of a conventional two-lamp vehicle headlamp device.
Figure 10A:
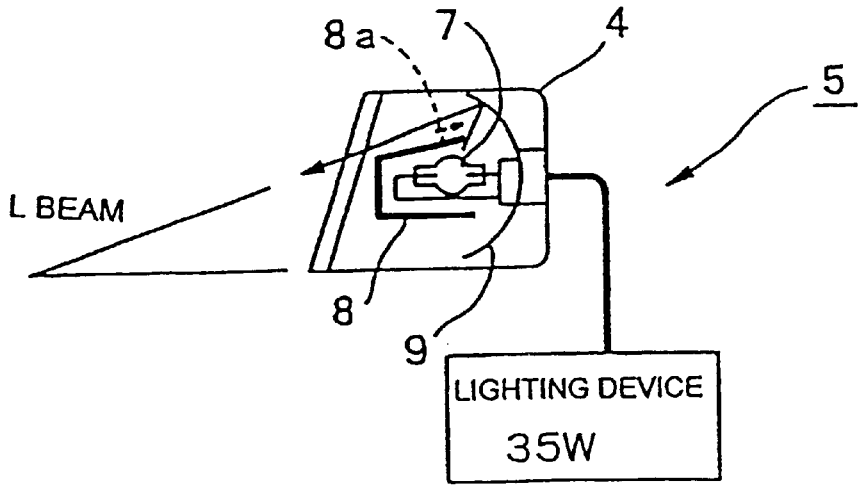
FIG. 10a CONVENTIONAL ART
FIGS. 10A–B illustrate the conditions during (A) L beam mode and (B) H beam mode in the conventional vehicle headlamp device shown in FIG. 9.
Figure 10B:
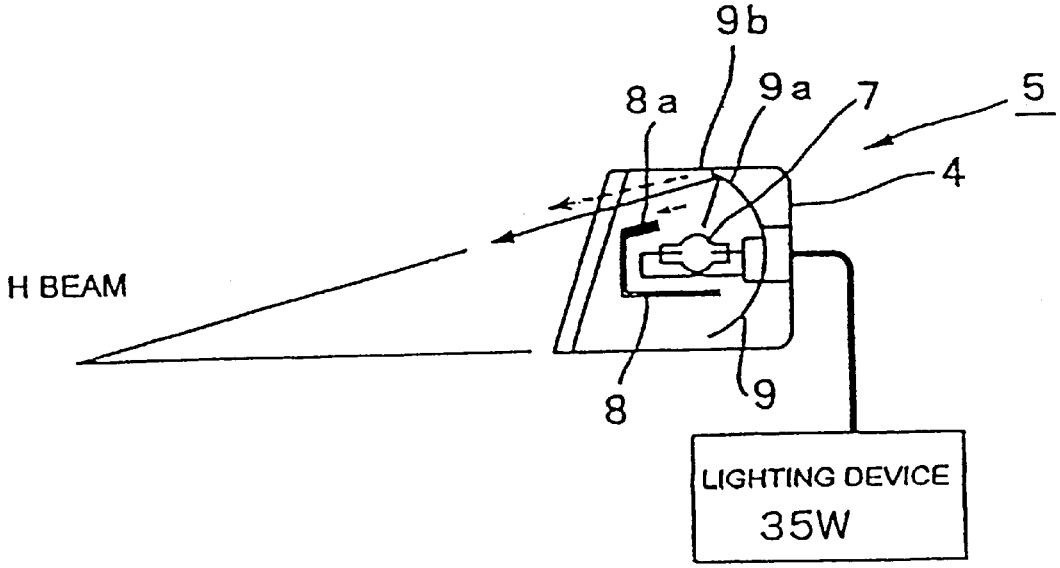
FIG. 10b CONVENTIONAL ART

FIGS. 7A–B illustrate yet another embodiment of the vehicle headlamp device of the invention. In FIG. 7A, the vehicle headlamp device 40 can differ from the vehicle headlamp device 10 shown in FIGS. 1 and 2 only in that the vehicle headlamp device 40 is equipped with a moving mechanism 41 which moves the discharge lamp 11 itself instead of the hood 13. The moving mechanism 41 can be considered a means for switching between the H beam and the L beam.

The moving mechanism 41 can be constructed from: a socket 42 to which the discharge lamp 11 is attached; a guide shaft 43 disposed on the outer circumferential surface of the socket 42; a hollow cylindrical rotating drum 44 disposed along the outer circumferential surface of the socket 42; and a solenoid 45 which causes the rotating drum 44 to be driven rotationally. Furthermore, the solenoid 45 can include a flange 45*a* that is press-fitted inside the rotating drum 44, and transmits the rotation of the solenoid 45 to the rotating drum 44.

The socket 42 can be equipped with a mouth piece 42*a* on its front surface into which the connection part of the discharge lamp 11 can be inserted. The socket 42 is supported so that it can move in the forward-rearward direction, but cannot rotate.

The rotating drum 44 can be equipped with a guide groove 44*a* with which the guide shaft 43 of the socket 42 engages. The guide groove 44*a* is preferably formed at an oblique angle with respect to the circumferential direction of the rotating drum 44, i.e., is formed so that the socket 42 can be shifted in the forward-rearward direction.

When the solenoid 45 is actuated, the rotating drum 44 is rotationally driven such that the guide groove 44*a* causes the guide shaft 43 of the socket 42 to move in the forward-rearward direction, thus causing the socket 42 and the discharge lamp 11 to move linearly in the forward-rearward direction. When the discharge lamp 11 moves in the forward direction, the discharge lamp 11 is brought to the L beam position, and when the discharge lamp 11 is moved in the rearward direction, the discharge lamp 11 is brought to the H beam position.

In the vehicle headlamp device 40 constructed as described above, as in the vehicle headlamp device 10 shown in FIGS. 1–5, the lighting control circuit 25 can supply to the discharge lamp 11 an electric power larger than the rated electric power only when the beam is switched to the H beam. The beam can be switched to H beam by movement of the socket 42 by the above-mentioned moving mechanism 41 which can be considered a switching means. Accordingly, any feeling that the quantity of light is insufficient that might occur when the H beam is in use is eliminated.

Thus, in vehicle headlamp devices 10, 30 and 40, the discharge lamp 11 is supplied with an electric power (38 W) that is larger than the rated electric power (35 W) only when the beam is switched to the H beam by the means for switching, e.g., hoods 13 or 31, or moving mechanism 41. As a result, during use of the H beam, the discharge lamp 11 utilizes a larger quantity of light such that the quantity of light is increased during use of the H beam and any feeling that the quantity of light is insufficient is eliminated. Good distant visual recognition characteristics along with a good feeling for the quantity of light in the forward field of vision are obtained.

In the embodiments of the invention described above, a two-lamp type vehicle headlamp device is described. However, the invention is not limited to such an embodiment. For example, it is also possible to apply the invention to a four-lamp type vehicle headlamp device.

Furthermore, in the embodiments described above, hoods 13 and 31 and a moving mechanism 41 for the discharge lamp 11 are used as means for switching between the H beam and the L beam. However, the invention is not limited to these embodiments. It is also possible to apply the invention to vehicle headlamp devices using other mechanisms for the means for switching, such as rack and pinion systems, fluid actuators, and other motive structures connected to either the light source or the hood.

Furthermore, in the embodiments described above, the lighting control circuit 25 can be constructed so that an electric power larger than the rated electric power is supplied to the discharge lamp 11 only when an H level switching control signal is input from the microcomputer 26 via the D/A converter. However, it is also possible to construct the lamp such that an L level switching control signal is input during the use of the H beam, and so that an electric power larger than the rated electric power is supplied to the discharge lamp 11 as a result of this signal input.

Furthermore, in the embodiments described above, a discharge lamp with a rated electric power of approximately 35 W can be used as a light source, and the system can be arranged so that an electric power of approximately 38 W is supplied during the use of the H beam. However, the invention is not limited to these embodiments. It is also possible to use a discharge lamp with other rated electric power. The electric power is preferably increased by an amount equal to approximately 20% or less of the rated power supplied during the use of the H beam.

The discharge lamp can be supplied with a larger electric power only when the beam is switched to the H beam by the switching means. Consequently, during the use of the H beam, the discharge lamp is lit by a larger quantity of light, so that any feeling that there is an insufficient quantity of light that might occur during the use of the H beam is eliminated. Accordingly, good distant visual recognition characteristics are obtained, and a good feeling in terms of the quantity of light in the forward field of vision is obtained. Furthermore, since there is no need to install a large auxiliary reflective part in order to compensate for an insufficiency in the quantity of light that occurs in conventional systems, the number of parts can be reduced, and a reduction in cost can be achieved. Furthermore, the overall size of the device can be reduced.

Thus, the invention provides a vehicle headlamp device in which switching between the L beam and H beam can be made easily, and any feeling of insufficiency related to the quantity of light can be eliminated. The invention also provides a simple construction with no need to install a large auxiliary reflective part on the reflective member.

What is claimed is:

1. A vehicle headlamp device, comprising:

a discharge lamp used as a light source;

means for switching said discharge lamp between a high beam and a low beam; and a lighting device which supplies power to the discharge lamp, said lighting device being constructed such that the electric power supplied to the discharge lamp is controlled to increase only when the beam is switched to the high beam by said means for switching.

2. The vehicle headlamp device as claimed in claim 1, wherein the increase in electric power effected by said lighting device during the use of the high beam is substantially equal to or less than 20% of the power supplied to said discharge lamp during the use of the low beam.

3. The vehicle headlamp device as claimed in claim 1, wherein the increase in electric power of said lighting device is performed in synchronization with the switching operation of said means for switching.

4. The vehicle headlamp device as claimed in claim 1, wherein the increase in electric power of said lighting device is performed in accordance with a switching command signal of said means for switching.

5. The vehicle headlamp device as claimed in claim 1, wherein said means for switching includes a hood used to block a portion of the light emitted from the discharge lamp and means for moving at least a portion of said hood, and the increase in electric power of said lighting device is performed in accordance with a hood movement command signal of said means for switching.

6. The vehicle headlamp device as claimed in claim 1, wherein said means for switching includes means for moving said discharge lamp, and the increase in electric power of said lighting device is performed in accordance with a discharge lamp movement command signal of said means for switching.

7. The vehicle headlamp device as claimed in claim 6, wherein said vehicle headlamp device includes a pair of discharge lamps and is constricted as a two-lamp system in which said discharge lamps are configured for placement at the right and left front of a vehicle, respectively.

8. The vehicle headlamp device as claimed in claim 5, wherein said vehicle headlamp device includes a pair of discharge lamps and is constructed as a two-lamp system in which said discharge lamps are configured for placement at the right and left front of a vehicle, respectively.

9. The vehicle headlamp device as claimed in claim 2, wherein said vehicle headlamp device includes a pair of discharge lamps and is constructed as a two-lamp system in which said discharge lamps are configured for placement at the right and left front of a vehicle, respectively.

10. The vehicle headlamp device as claimed in claim 1, wherein said vehicle headlamp device includes a pair of discharge lamps and is constructed as a two-lamp system in which said discharge lamps are configured for placement at the right and left front of a vehicle, respectively.

11. A vehicle lamp, comprising:

a discharge lamp that includes an H beam operating mode and an L beam operating mode;

a switch connected to said discharge lamp and configured to switch said discharge lamp between said H beam operating mode and said L beam operating mode; and a lighting device which supplies power to said discharge lamp, said lighting device configured to provide a first amount of power to said discharge lamp when said discharge lamp is in said H beam operating mode, and to provide a second, different amount of power to said discharge lamp when said discharge lamp is in said L beam operating mode.

12. The vehicle lamp device as claimed in claim 11, wherein said first amount of power is greater than said second amount of power.

13. The vehicle lamp device as claimed in claim 12, wherein said first amount of power is substantially equal to or less than 120% of said first amount of power.

14. The vehicle lamp device as claimed in claim 11, further comprising:

a hood located adjacent said discharge lamp and configured to block a first portion of light emitted from the discharge lamp, said hood including a movable portion that can be moved to block a second portion of the light emitted from the discharge lamp.

15. The vehicle lamp device as claimed in claim 14, wherein said hood includes a hood concave portion, and said movable portion includes a movable concave portion that is configured to be moveable into said hood concave portion.

16. The vehicle lamp device as claimed in claim 11, further comprising:

a movable mount connected to said discharge lamp and configured such that said discharge lamp can be moved between a first position in said L beam operating mode and a second, different position in said H beam operating mode.

17. The vehicle lamp device as claimed in claim 16, further comprising a solenoid located adjacent said movable mount such that the solenoid can move said moveable mount.

18. The vehicle lamp device as claimed in claim 16, wherein said movable mount includes a groove structure and a shaft structure each located on one of a rotary structure and a socket structure, such that rotation of said rotary structure can cause said socket structure to move in a substantially linear path.

19. The vehicle lamp device as claimed in claim 11, further comprising:

a second discharge lamp light source, wherein said discharge lamp and said second discharge lamp are configured for placement at the right and left front of a vehicle, respectively.

20. A method for controlling a vehicle lamp, wherein said vehicle lamp includes a discharge lamp light source with an H beam operating mode and an L beam operating mode, a switch connected to said discharge lamp configured to switch said discharge lamp between said H beam operating mode and said L beam operating mode, and a lighting device which supplies power to said discharge lamp and is configured to provide a first amount of power to said discharge lamp when said discharge lamp is switched to said H beam operating mode and to provide a second, different amount of power when said discharge lamp is switched to said L beam operating mode, said method comprising the steps of:

connecting power to said discharge lamp and illuminating said discharge lamp;

manipulating said switch to switch said discharge lamp between said H beam operating mode and said L beam operating mode; and causing a first amount of power to be supplied to said discharge lamp when said discharge lamp is switched to said H beam operating mode, and a second, different amount of power to be supplied to said discharge lamp when said discharge lamp is switched to said L beam operating mode.

* * * * *